US005459964A

United States Patent [19]

Doublet

[11] Patent Number: 5,459,964

[45] Date of Patent: Oct. 24, 1995

[54] STEPPED GRANDSTANDS WITH TELESCOPIC ELEMENTS

[75] Inventor: Luc Doublet, Seclin, France

[73] Assignee: Ets. Doublet, Avelin, France

[21] Appl. No.: 195,373

[22] Filed: Feb. 14, 1994

[30] Foreign Application Priority Data

Feb. 17, 1993 [FR] France ..... 93 01792

[51] Int. Cl.[6] ..... E04H 3/12

[52] U.S. Cl. ..... 52/8; 52/7

[58] Field of Search ..... 52/6, 7, 8, 9, 10

[56] References Cited

U.S. PATENT DOCUMENTS

| | | | |
|---|---|---|---|
| 3,389,511 | 6/1968 | Drehobl . | |
| 4,285,172 | 8/1981 | Quigley . | |
| 5,069,007 | 12/1991 | Paddock . | |
| 5,277,007 | 1/1994 | Bryant | 52/8 X |

FOREIGN PATENT DOCUMENTS

| | | | |
|---|---|---|---|
| 330838 | 9/1989 | European Pat. Off. | 52/8 |
| 430931 | 6/1991 | European Pat. Off. | 52/8 |
| 2326557 | 4/1977 | France . | |
| 2651822 | 9/1989 | France . | |
| 3709753 | 10/1988 | Germany . | |
| 94025706 | 11/1994 | WIPO | 52/8 |

*Primary Examiner*—Carl D. Friedman
*Assistant Examiner*—Creighton Smith
*Attorney, Agent, or Firm*—Roland Plottel

[57] ABSTRACT

A foldup grandstand, in which the rows of seats telescope into an unfolded position with the rows of seats available for the spectators, or into a folded position in which the rows of seats are nested one above the other. A series of frames with wheels support the seats, and a V-shaped pieces and frame aligned with a centering finger on an adjacent frame to join the two frames together. The finger has a bent shape and a special head which facilitates its alignment with the V-shaped piece. A self-locking element, rollers, ballast, drivers, cable drives, and an immobilization or locking members are also parts of the grandstand mechanism.

12 Claims, 6 Drawing Sheets

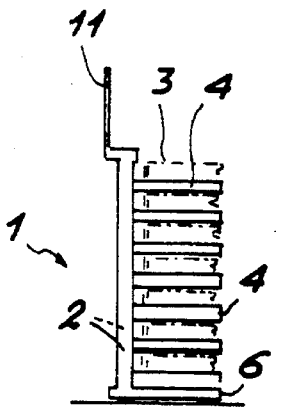
FIG. 1 a
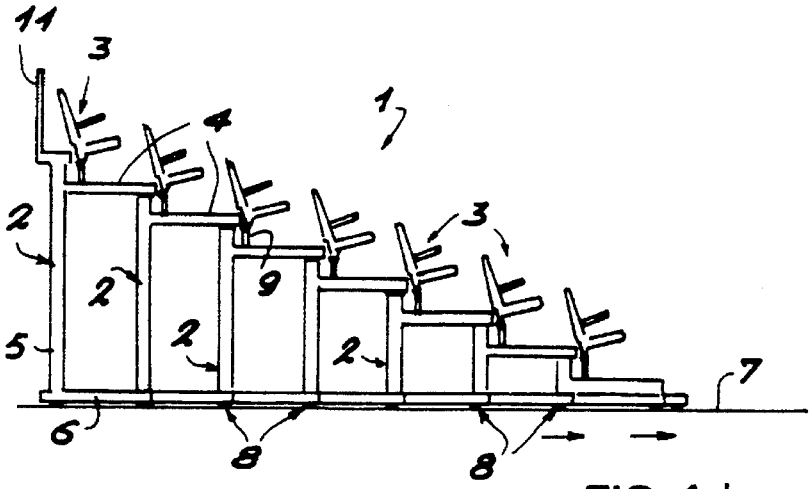
FIG. 1 b
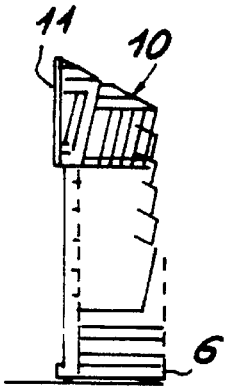
FIG. 2 a
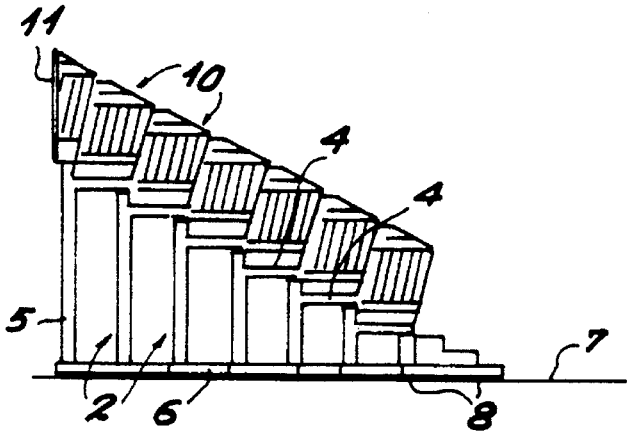
FIG. 2 b
FIG. 3
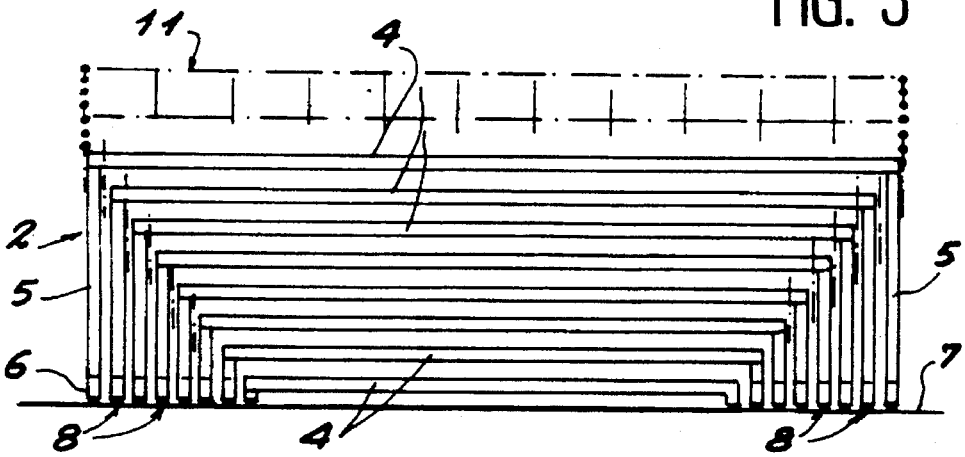

2
30
33
31
27
36
34
35
29
32
37
7
8
6
4
21
15
3
14
19
28
12
25

STEPPED GRANDSTANDS WITH TELESCOPIC ELEMENTS

BACKGROUND OF THE INVENTION

1. Field of the Invention

The present invention relates to a fold-up grandstand formed of successive elements including steps for establishing rows of neighboring seats at different heights, evenly distributed from the top to the bottom of the grandstand, each element being capable of being housed respectively under the previous one whilst surmounting the next one in the folded up position of the grandstand whilst, in the unfolded position, in which each element is completely extracted from the previous one and located in front of it, each row of seats is offset with regard to the previous one located at a higher level and also with regard to the one which is after it at a lower level.

2. Description of the Prior Art

Embodiments of this type are already known in which a plurality of telescopic elements, together forming a staircase-type structure, is designed to be deployed or folded up, the elements nesting in one another whilst being associated with means for controlling their movements, especially in order to tend to provide a perfectly rectilinear relative displacement of these various elements whilst maintaining their parallelism in any position. By way of example, reference may be made, in order to illustrate such an embodiment, to FR-A-2 651 822 of the Applicant Company, or to DE-A-2 709 150 or even to U.S. Pat. No. 4,193,229, in which, however, the mechanisms adopted are less effective than in the first case, the parallelism of the elements not being suitably provided and risking, when opening just as when closing the grandstand, creating prejudicial jamming between these successive elements.

It is, however, noted, even with the arrangements envisaged in the aforementioned French patent, that the result obtained is still not optimal, it sometimes not being possible for the structure of the grandstand to prevent lateral loads which are exerted on the elements with respect to one another, particularly if the ground on which the grandstand is placed is not strictly flat and uniform, from bringing about a more or less limited offset between the successive elements during their relative translational movements, during movements for opening and closing this grandstand.

SUMMARY OF THE INVENTION

The subject of the present invention is a grandstand with telescopic steps, of the general sort recalled hereinabove, formed of successive stepped elements, of height decreasing from one to the next, and which are capable of being mutually nested in the folded up position of the grandstand or, conversely, deployed in the unfolded position of the latter, depending on the case, so as to for a staircase structure, these elements being associated with means for operating and controlling their relative displacements, which means add particularly advantageous improvements to such a grandstand, especially by automatically correcting any possibly offset position from one element to the next, such that opening and closing of the grandstand takes place with these elements always remaining strictly mutually parallel.

For this purpose, the grandstand in question, including a plurality of telescopic elements each one supporting at least one row of neighboring seats, these elements exhibiting different successive heights, decreasing evenly from one element to the next from the top to the bottom of the grandstand, each element being capable of being housed respectively under the previous one whilst surmounting the next one in the folded up position of the grandstand whilst, in the unfolded position, in which each element is completely extracted from the previous one and located in front of it, each row of seats is offset with regard to the previous one located at a higher level and also with regard to the one which is after it at a lower level, each element including a member for recent e ring in the plane which contains the direction of displacement of the element in the direction of unfolding the grandstand such that, by degrees, the directions of displacement of all the successive elements are strictly mutually parallel, in which each element has the shape of a portal frame with a horizontal upper platform supporting the row of seats, and two parallel or oblique lateral uprights symmetric with respect to the median plane of the grandstand, extending along the sides of this element, the next element being housed in the preceding element with its platform and its lateral sides respectively parallel to those of this previous element, under and inside the latter, and in which each of the lateral uprights of an element includes at least one leg on which the horizontal platform is fixed at its upper part and which is secured, at its lower part, to a support base equipped with wheels for displacement mounted so that they can rotate freely about horizontal axles carried by the base and extending perpendicularly to the direction of displacement of the element, is one wherein the leg of at least one of the uprights of each element includes an open attached piece in the shape of a V, the apex of which is welded or otherwise secured to the leg along one generatrix of the latter, preferably in a median plane of the upright, this piece being designed to interact with a profiled centering finger located in the same median plane but carried by the support base of the next element opposite the V-shaped piece attached to the leg of the latter, such that, at the end of displacement of the base of a first element, the centering finger carried by the base of the next element engages in the V-shaped piece of said first element, thereby aligning the two elements and so on from one element to the next.

The centering finger is especially supported by a block fixed to the base of one element and extends, laterally overhanging above the base of the preceding element, this finger consisting of a rod which is slightly bent toward the V-shaped piece of this preceding element and terminating in a spherical head facilitating its engagement in this piece and its gliding over at least one of its sides as far as its apex in the median plane of the upright which supports it.

According to another advantageous feature of the grandstand with telescopic steps in accordance with the invention, one of the legs of at least one of the uprights of each element includes a locking lever which is articulated about a horizontal axle carried by the leg, this lever including an operating arm and a fastening fluke designed to immobilize a preceding element with regards to the next element at the end of relative displacement of these two elements, when the centering finger is engaged to the bottom of the V-shaped piece, the lever tilting under its own weight when a stop piece carried by the next element is negotiated. Advantageously, the fastening fluke includes a bevel for facilitating its gliding over the stop piece giving rise to it being raised, through pivoting about its horizontal axle, the elements being set out such that they are successively locked from one element to the next in the unfolded position of the grandstand and unlocked in step with its successive elements being folded up.

Preferably, and a way which is in itself known, the elements of the telescopic grandstand are joined to one another by means of a compasses member comprising two branches which are articulated like a pair of scissors, the ends of the two branches being respectively articulated onto one element and onto the adjacent element, while the other ends of these branches are articulated onto a guide mounted so that it can slide in a position-adjustment bar, respectively carried by each of the two elements, such that the opening or closing of the compasses element moves these elements apart or brings them together whilst the guide for each branch slides on the associated bar.

Advantageously, the ends of each of the two branches of the compasses element are respectively articulated to a tab forming a vertically turned-down piece, provided in the front face of the first element and on an end wall turned vertically upward formed in the rear face of the next element which carries the adjustment bar, such that the compasses element which extends under the platform of the first element is open in the folded up position of the two elements, and closed in the unfolded position of these same two elements.

According to yet another feature of the grandstand in question, each support base of a lateral upright of an element includes a self-contained drive member, consisting of a roller equipped with an incorporated axial motor, the rotation spindle carried by the roller extending parallel to the axles of the wheels for displacement of the element and being secured to a vertical groove formed in the base, allowing the roller to bear on the ground and allowing it a limited lift in the presence of unevenness of this ground. Also preferably, the support base includes, on either side of the roller, masses for ballast and for bearing on the ground. Advantageously, these ballast masses consist of containers filled with sand or some other equivalent heavy material.

Finally, and according to yet another complementary feature of the invention, the element of least height, designed to be located at the front of the grandstand in the deployed position, includes a manual drive member of the sliding drawbar type, ending in a hook capable of interacting with a spindle carried by the base of this element in order to allow a tensile force to be exerted on the latter, ensuring its deployment.

Advantageously, the drawbar is mounted so that it acts on a flap articulated to the base and to which the end of a cable is fixed, the other end of this cable being secured to a locking lever capable of releasing the first element as regards the preceding element, and so on from one element to the next.

BRIEF DESCRIPTION OF THE DRAWINGS

Other features of a telescopic grandstand with superimposed steps, set out in accordance with the invention, will further emerge via the description which follows of one embodiment, given by way of non-limiting indication, with reference to the appended drawings in which:

FIGS. 1*a* and 1*b* diagrammatically illustrate a telescopic grandstand according to the invention, including superimposed rows of seats, the grandstand being represented in transverse section through a plane which extends perpendicularly to its direction of unfolding, the grandstand being represented in the folded up position in FIG. 1*a* and in the unfolded position in FIG. 1*b*.

FIGS. 2*a* and 2*b* are also diagrammatic views of the grandstand according to FIGS. 1*a* and 1*b* respectively, but represented from the side, in order to illustrate the fitting of appropriate railings or balustrades to the edges of this grandstand.

FIG. 3 is a rear elevation of the grandstand represented in FIGS. 1 and 2, illustrating the relative layout of the various telescopic elements which it includes, particularly of the platform and of the lateral uprights.

DESCRIPTION OF THE PREFERRED EMBODIMENTS

Figure 4:
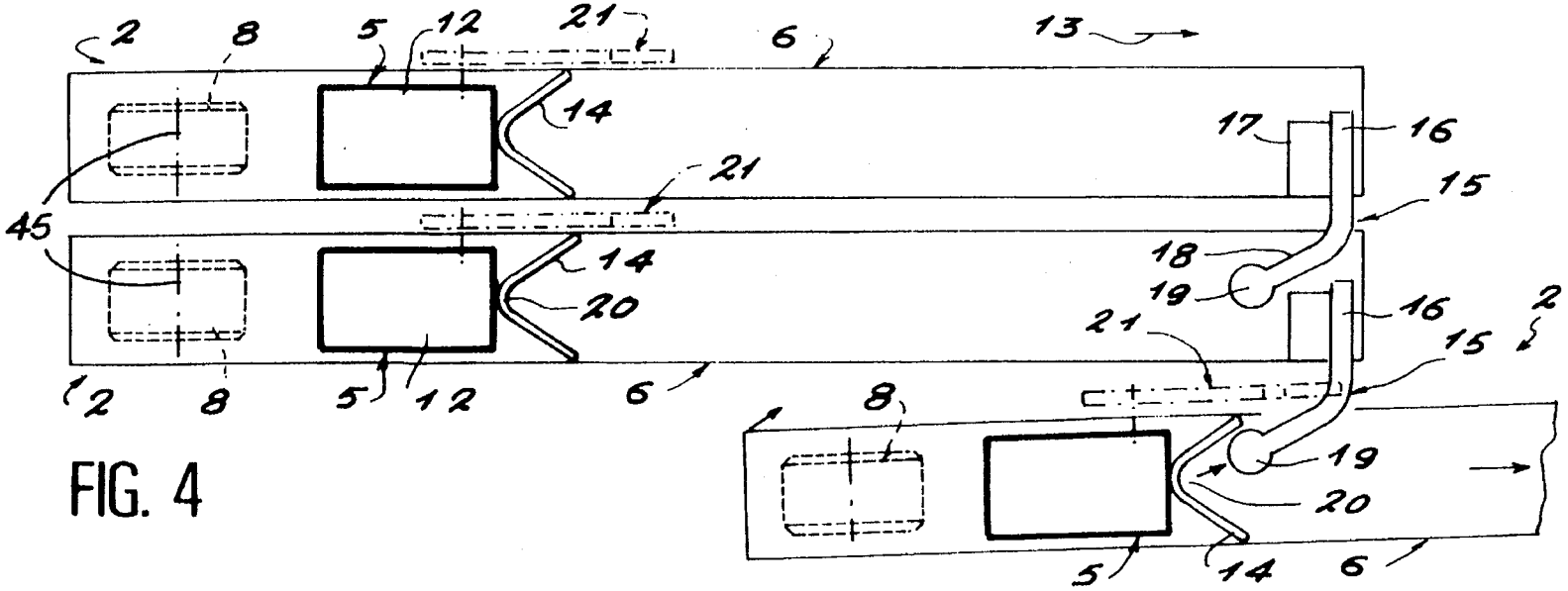
FIG. 4 is a plan view on a larger scale of the bases of three successive elements of the grandstand, illustrating more particularly the means making it possible to readjust these elements during their relative displacements.

In FIGS. 1 to 3, the reference 1 diagrammatically denotes a telescopic grandstand, of a type which is in itself known in the art, and especially including a plurality of successive elements 2, the heights of which vary from one element to the next from the back to the front of the grandstand, so as to allow their mutual nesting when the grandstand is folded up as illustrated in FIGS. 1*a* and 2*a* or, in contrast, when the grandstand is unfolded as represented in FIGS. 1*b* and 2*b*, thereby allowing rows of seats such as 3 to be located from the back to the front of the grandstand at different levels, each row of seats being located above and behind on any element whatsoever of given height, as regards the row carried by the preceding element of lesser height.

Each telescopic element 2 of the grandstand 1 exhibits the overall shape of a portal frame, and essentially includes a horizontal upper platform 4 on which a row of seats 3 rests, and lateral legs 5 secured, at the lower part of the element, to a support base 6, the latter resting on the ground 7 through rolling means 8 which are very diagrammatically featured in the drawings. In the latter, the lateral legs 5 of each telescopic element have been represented extending vertically, such an arrangement being envisaged solely by way of indication. In particular, it would be equally possible to envisage arranging these legs with a given inclination to the vertical, the two legs of each element being symmetric to one another with respect to the median plane of the grandstand. In this case also, it is possible to envisage connecting the two inclined and symmetric legs of each element using connection rods or other means for making the assembly thus formed more rigid.

The platforms 4 of the successive elements 2 are located at different heights from one element to the next, such that they can be located one under the other when the grandstand is folded up, in this case occupying a minimal volume as illustrated in FIGS. 1*a* and 2*a*, in which all the platforms are thus superimposed in the direction of the height of the grandstand. For this purpose, the seats 3 of the various platforms are supported by the latter by means of a device 9 with a spring or the like, known per se, allowing the back rest of the seat to be folded down onto the latter, such that when all the elements 2 are nested together, the seats occupy the space left free between these platforms, underneath them, the unfolding of the grandstand making it possible, in contrast, in step with the deployment of each element, to stand the seats back up again, which seats then occupy the position represented diagrammatically in FIG. 1*b*.

As represented in FIG. 2, the telescopic elements 2 of the grandstand advantageously include, at their lateral ends, railings or balustrades 10 which, like the elements, sit respectively in one another when the grandstand is folded up, as illustrated in FIG. 2*a*, and are located one after another, thereby providing continuity of the protection thus produced, especially as regards falls from the two sides of the grandstand.

FIG. 3 illustrates the grandstand of FIGS. 1 and 2 seen from the rear, each element 2 including a platform 4 and lateral legs 5 ending in bases 6, these legs 5 being located from one element to the next on either side of the platform 4 which they support, but moving closer to the median plane of the grandstand in step with the decrease in height of the platform of the element in question, the assembly thus allowing all the elements to be completely nested under one another.

The last element 2 is advantageously equipped, to the rear of its platform 4, with a back wall or end railing 11 for the whole of the grandstand, like the balustrades 10, affording protection as regards falling off the back, from the platform 4 located at the highest level.

The overall structure of a grandstand with telescopic elements of the sort outlined hereinabove with respect to FIGS. 1 to 3 is, in itself, conventional. In contrast, and in accordance with the invention, this structure is improved by the implementation of means which make it possible to provide guidance of the various elements with respect to one another, such that they remain perfectly aligned and mutually parallel during the operations of unfolding and folding up the grandstand, thereby preventing the risks of Jamming or of prejudicial loads in the various parts of the latter.

FIG. 4 thus illustrates, on a larger scale, the measures adopted in order to allow such an automatic takeup of the possible play of one element with respect to the next one during the operations carried out in order to use the grandstand, especially for mutually extending the various elements in the unfolding phase, or, in contrast, bringing them together and nesting them in the folding up phase.

In this figure, viewed from above, can be seen the bases 6 of three neighboring elements 2 mutually nesting in one another in the folded up position of the grandstand, each element including, on either side on its lateral sides, a vertical leg 5 for supporting the upper horizontal platform 4 (here not represented), this leg especially consisting of a metal upright 12 which, in the example in question, has a rectangular cross section.

According to the invention, each upright 12 is equipped, in its lateral surface, pointing in the direction of the relative displacement of the bases 6 with respect to one another when the grandstand is unfolded, which direction is represented diagrammatically by the arrow 13 in FIG. 4, with a guide piece 14 in the shape of a V open towards the outside, the apex of this V being welded or otherwise fixed against the outer surface of the upright 12.

This V-shaped guide piece 14 is intended to interact with a centering finger 15, each base 6 of any element whatsoever 2 including such a finger formed of a metal rod 16 welded onto a block 17 and exhibiting, opposite, a bent end 18, preferably ending in a ball 19. Each base 6 of an element, at the opposite end of this base from the one in the vicinity of which the leg 5 is provided with its vertical upright 12 equipped with the V-shaped piece 14 and which supports the horizontal platform 4 of the corresponding element, thus includes a centering finger 15 which extends laterally in order to exhibit its bent part 18 and the centering ball 19 provided on the latter, opposite the piece 14 of the neighboring base 6, belonging to the element 2 of the grandstand which, when the latter is unfolded, is located in front of the preceding one which carries this finger 15, and so on from one element to the next.

As represented in FIG. 4, it is thus understood that each element 2 can be displaced as regards the preceding element in the direction of unfolding of the grandstand, until the V-shaped piece 14 which its uprights 12 bear are offered up in line with the ball 19 of a centering finger 15, this ball thus being placed, by virtue of its profile, to slide against one of the inclined sides of the V-shaped piece 14. This movement continues for as long as one of the bases 6 is being displaced as regards the preceding one, until the ball 19 carried by the finger 15 of one of these bases reaches the bottom or apex 20 of the piece 14 of the other base, while exerting, right through this phase of the finger penetrating into the piece, a force for bringing the two bases together and finally perfect alignment of the elements 2 which they support, while retaining their parallelism despite possible faults in the ground that the rolling means 8 belonging to each element encounter.

Figure 5:
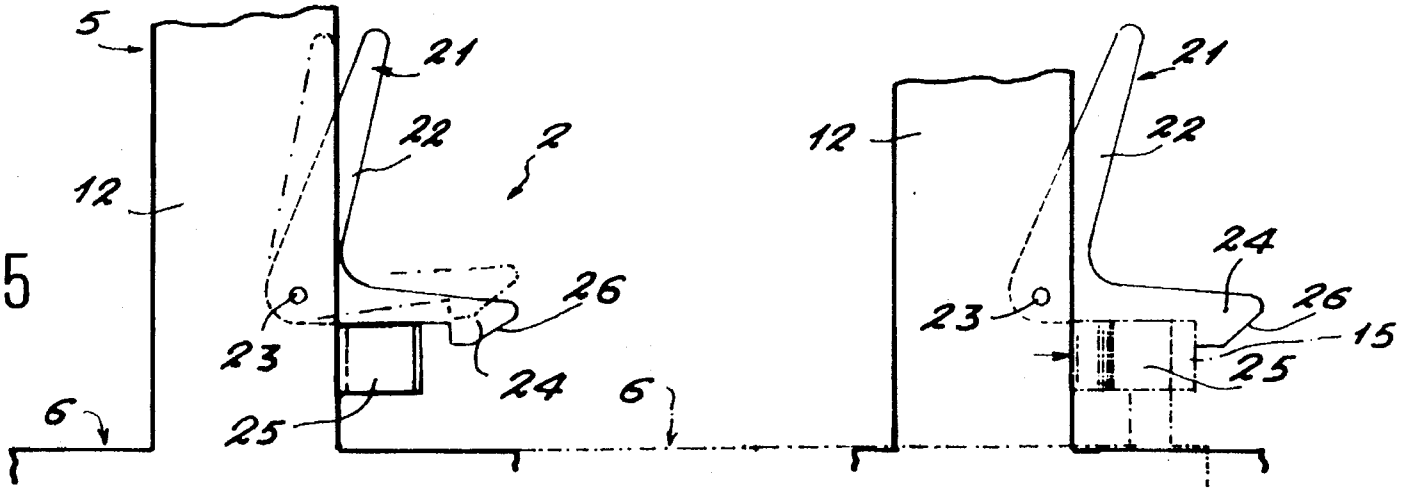
FIG. 5 is a partial side view of two bases according to FIG. 4, and of the uprights of the legs associated with these bases, illustrating the means for mutual locking of the various elements.

FIG. 5 illustrates a locking means 21, advantageously carried by each upright 12 extending from the corresponding base 6 in order to allow, at the end of travel, immobilization of the telescopic elements 2 from one to the next, with relative locking of these elements in the unfolded position of the grandstand, the effect of folding up the element located right at the front in the grandstand, making it possible, by degrees, to bring the associated locking means into a non-obstructing position and to allow, from one element to the next, mutual nesting of the latter in order to end up, at the end of the operation, with the structure illustrated in FIGS. 1*a* and 2*a* in which all these elements are nested together.

For this purpose, each upright 12 of one element 2 includes a hook 22, articulated about an axle 23 carried by this upright and ending in a fluke 24 capable of being located behind a stop 25 carried by the next element 2, thereby, under these conditions, immobilizing the two neighboring bases 6 respectively carrying the hook and the stop.

Advantageously, each hook 22 includes a bevelled surface 26, provided opposite the fluke 24, and set out such that in the opposite movement of the elements 2 with regard to one another, and in particular when the grandstand is being folded up, each stop 25 of a base 6 becomes applied against the bevel 26 of the fluke 24 belonging to the hook 22 of the base 6 of the preceding element 2, thereby raising this hook and releasing the stop in order to allow the side-by-side final alignment of all the bases in the folded up position of the grandstand.

FIGS. 6 and 7 to 9 illustrate other arrangements advantageously implemented in a grandstand with telescopic elements according to the invention.

Figures 6, 7:
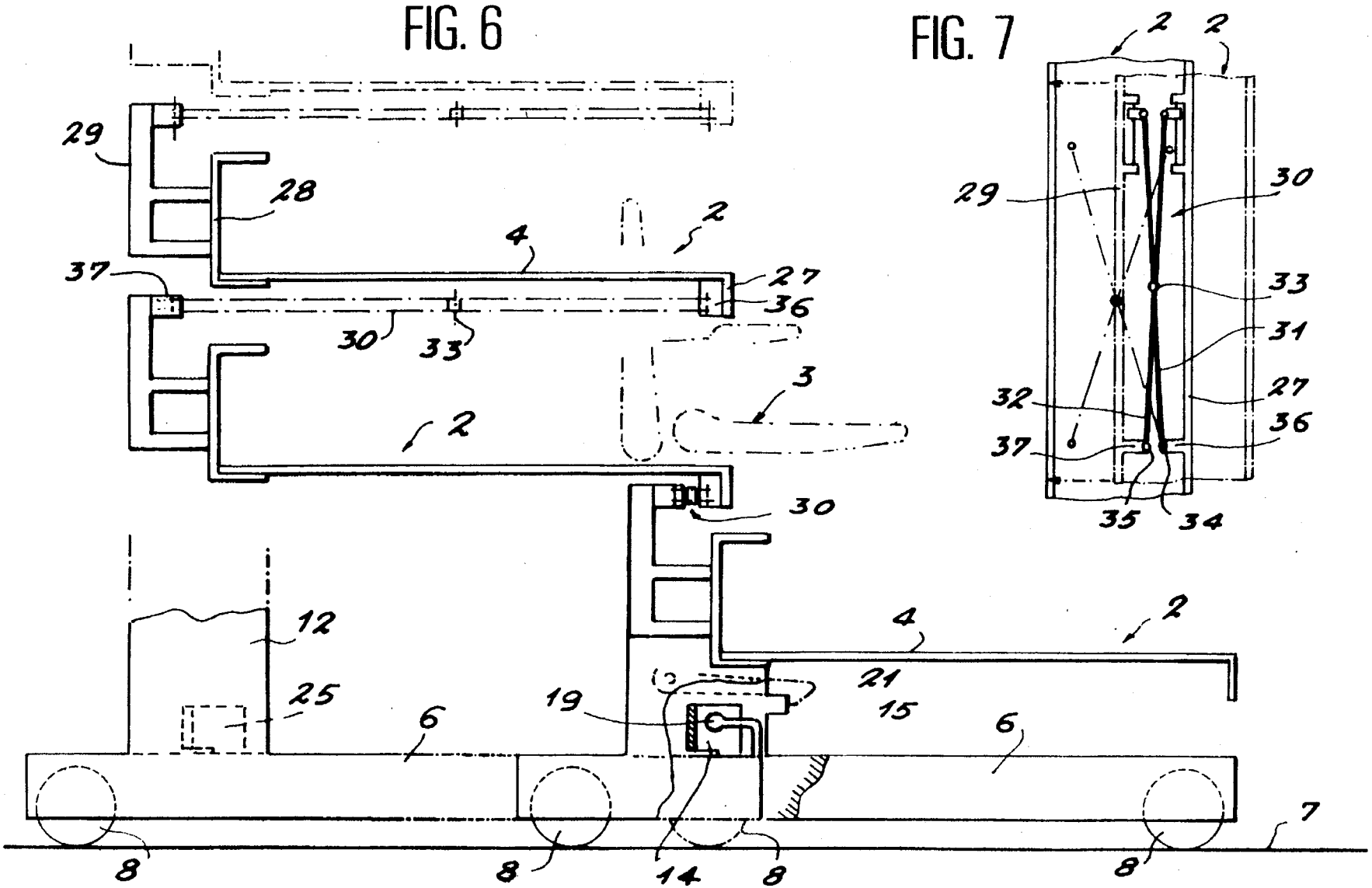
FIG. 6 is an elevation and partial section of two telescopic elements of the grandstand, making it possible to understand better the way in which these elements are displaced with respect to one another.
FIG. 7 is a plan view on a smaller scale of a compasses element with articulated branches, used to ensure the unfolding or folding up of two successive elements of the grandstand.

Thus, and as represented in FIG. 6, the upper horizontal platform 4 of each element 2 includes, in its front part in the direction of displacement of the elements for unfolding the grandstand, a vertical planar rim 27 pointing down and, opposite, a back wall 28 against which an end framework 29 is attached, extending over a given height above the plane of the platform 4, this framework nevertheless exhibiting a height less than that which separates two superimposed successive platforms in the grandstand, in the folded up position of the latter.

Figure 8:
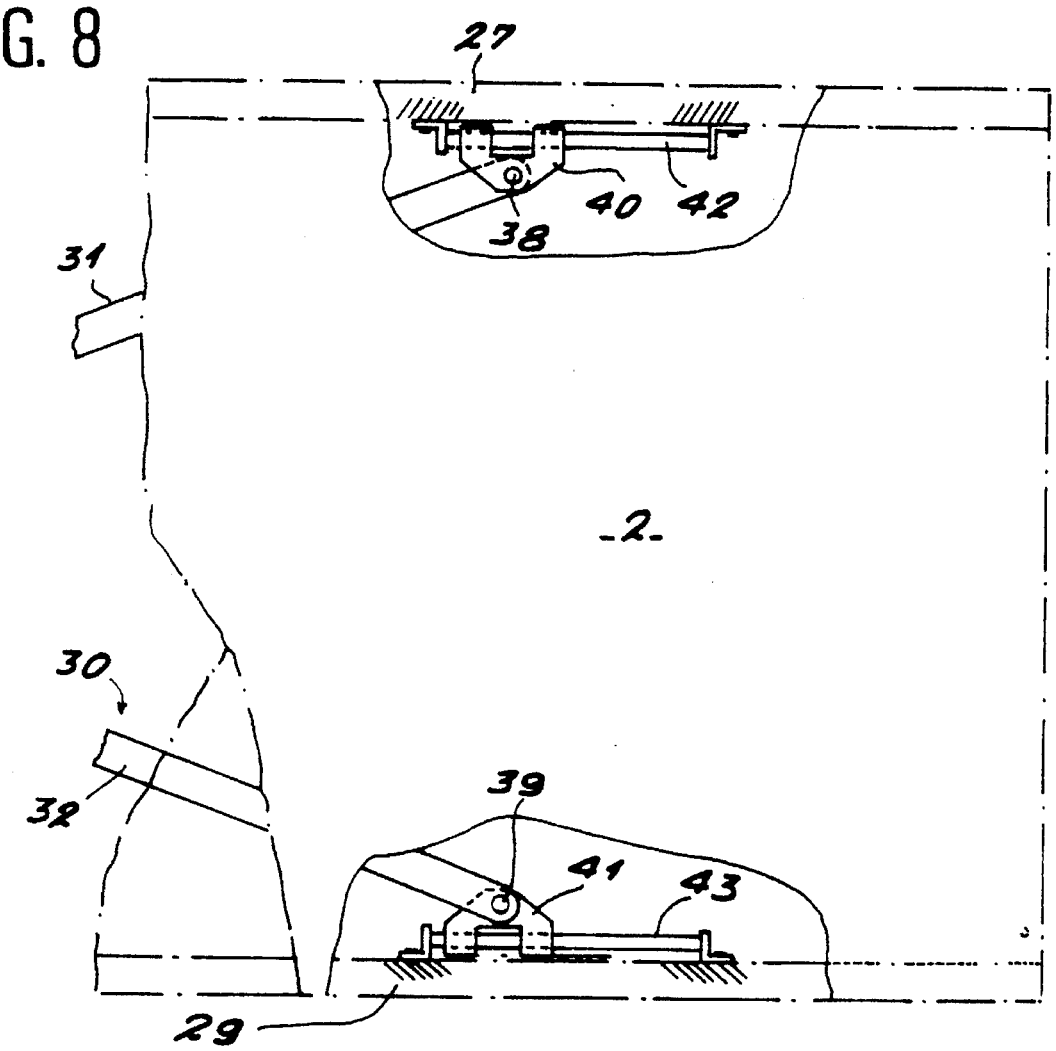
FIGS. 8 and 9 are detailed views on a larger scale of the compasses element according to FIG. 7, respectively in the open and closed position of this compasses element.
Figure 9:
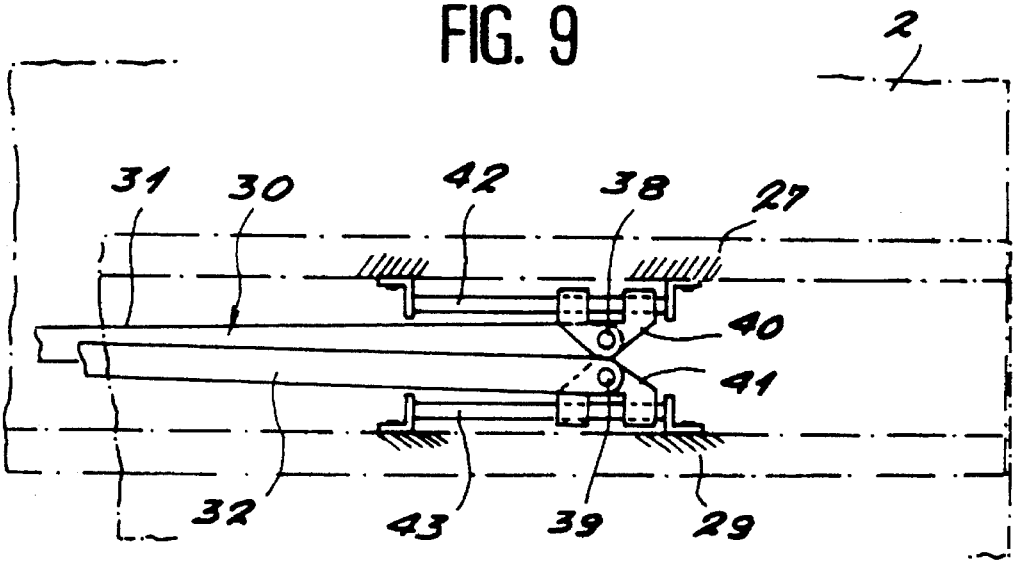

According to the invention, the spacing of any two adjacent elements 2 whatsoever in the grandstand, particularly for producing the unfolding of the latter, is controlled by means of a compasses device 30, of which FIG. 7 illustrates more particularly one embodiment, FIGS. 8 and 9 specifying some details of the use of such a device.

Advantageously, the compasses device 30 includes two branches, respectively 31 and 32, mutually articulated about a common axle 33, these branches likewise being articulated about axles 34 and 35 carried by tabs 36 and 37, respectively formed on the front rim 27 of a first element and on the end framework 29 of another element.

In the exemplary embodiment represented, the rim 27 preferably belongs to an element 2 located behind the adjacent element 2 to which the structure 29 is attached, such that closure of the compasses element 30 formed by the two articulated branches 31 and 32 produces the separation of the two elements, the opening of the compasses element conversely bringing these two same elements together, the next element in the direction of unfolding of the grandstand becoming housed and nested under the preceding element. FIG. 7 represents, respectively in solid lines, the compasses element 30 in the closed position with separation of the two elements 2 thus joined, and, in chain line, the compasses element in the open position, causing these elements to be brought together, these positions emerging also from FIG. 6.

In order to accommodate the excursions of the compasses element 30 and in particular the relative displacements of its branches 31 and 32, the ends of the latter, opposite the axles 34 and 35, are themselves articulated about axles 38 and 39 on sliding pieces 40 and 41 respectively (see FIGS. 8 and 9), which are capable of being displaced on guide rods 42 and 43 carried, on the one hand, by the rim of a first element 2 and, on the other hand, by the framework 29 of the adjacent element, these rods extending parallel to one another and perpendicularly to the direction of displacement of the telescopic elements themselves when the grandstand is being folded up or unfolded.

Figure 10:
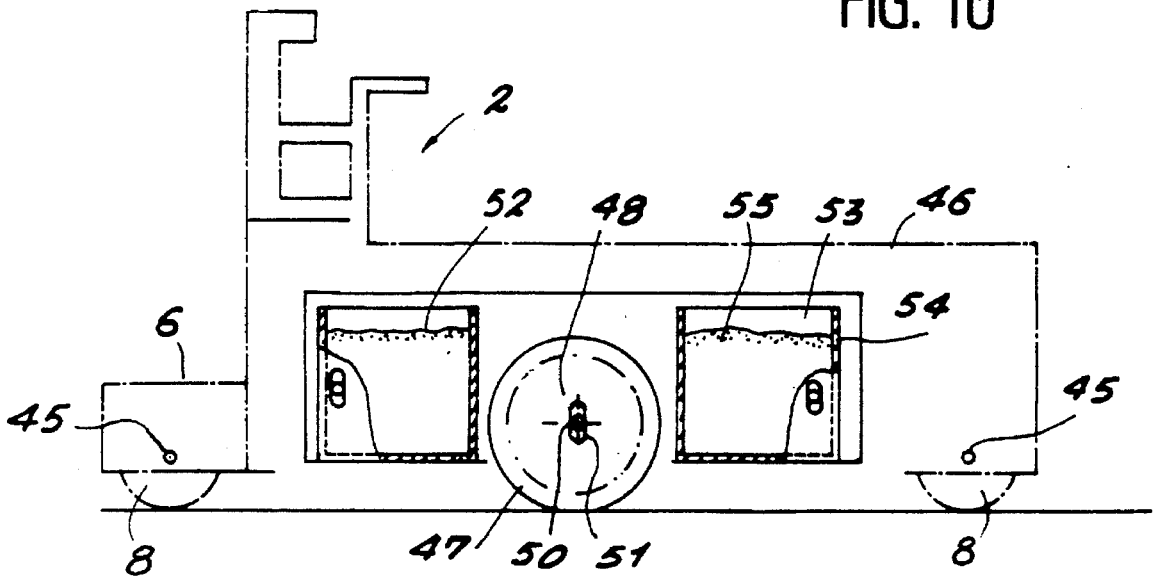
FIGS. 10 and 11 are views, respectively in elevation and in plan, of the means associated with the base of any element of the grandstand in order to allow it to be displaced as regards the ground, so as to unfold or fold up the grandstand, depending on the direction.
Figure 11:
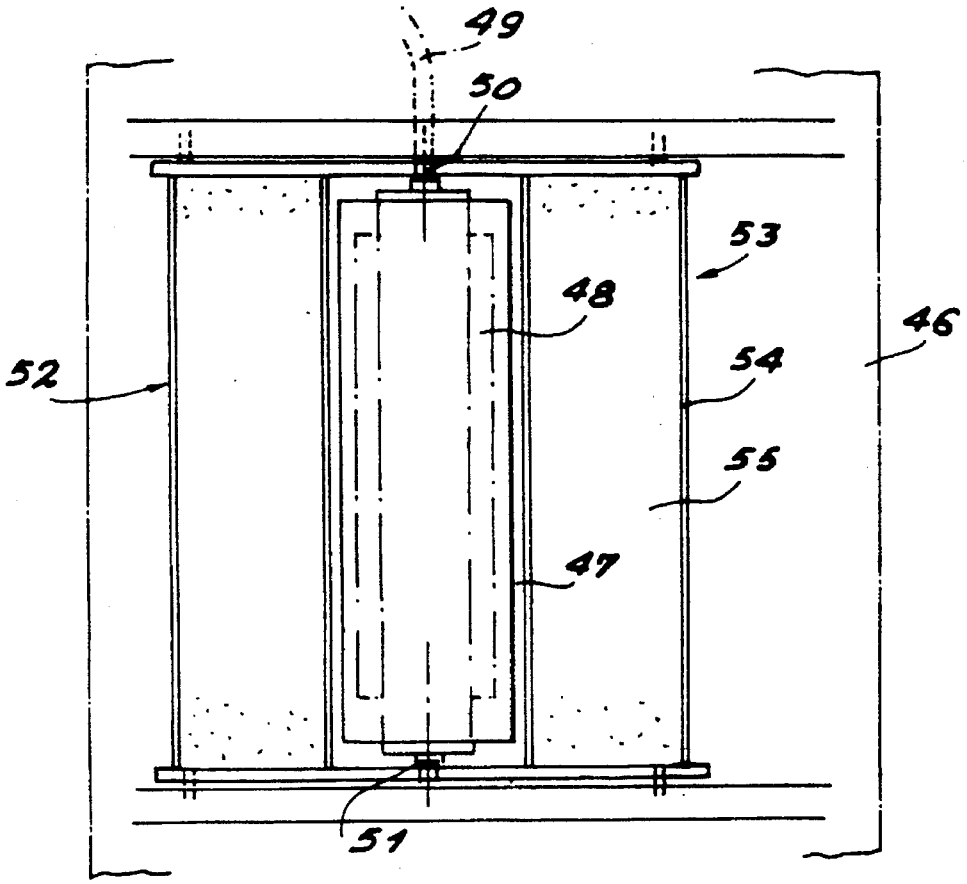

FIGS. 10 and 11 illustrate another arrangement advantageously implemented with the grandstand with telescopic elements of the invention, in order, particularly, to ensure the relative displacement of these various elements along the ground 7, thereby entraining the rolling means 8 associated with each base 6.

Preferably, at least one of these bases, because the movement of any one of them repercusses by degrees on the others in the grandstand, but, if necessary, each of them, includes, besides wheels 48 for bearing on the ground, which are mounted freely about axles 45 which extend perpendicularly to the direction of displacement of the telescopic elements 2 during the phases of folding up or unfolding the grandstand, a casing 46 in which is mounted a roller 47 with axial motor 48, the latter being powered by a cable 49. The axle 50 of the roller 47 is mounted so that it can move in an axial groove 51 provided in the sides of the casing 46, so that it can absorb the variations and possible unevennesses of the ground 7 and permanently exert, on the latter, via the outer surface of the roller, a load whilst, by reaction, bringing about the displacement in the opposite direction of the base 6 and of the element 2 carried by the latter. Advantageously, the casing 46 includes, on either side of the roller 47, ballast masses 52 and 53, respectively consisting of containers 54 filled with sand or the like 55.

The equipment of the grandstand with telescopic elements according to the invention may be supplemented by fitting to the element 2 located furthest forward and which consequently exhibits the platform 4 of least height, a manual operating device making it possible to exert, on this element, an appropriate tensile load and, in combination or separately with the movement created by the driving roller 47 seen hereinabove, to bring about the unfolding of the grandstand or, conversely, its folding up. Such a manual operating device is preferably utilized for grandstands of smaller dimensions where the deployment of the grandstand does not require an excessive force, the telescopic elements being less numerous, and of a relatively limited individual weight.

For this purpose, the device includes a drawbar 55 equipped at one end with a hand grip 56 and, at the other end, with a hook 57 capable of engaging over an axle 58 secured to the front face of the element 2 to be pulled.

In periods of non-use, the drawbar 5 is located in a housing 59 provided in the base 6 of the element, extraction of the drawbar in order to bring it to the drawing position with its hook 57 engaged on the axle 58 taking place after a tilting flap 60 articulated at 61 to the front of the element 2 has been raised.

In a particular embodiment, the flap 60 may be secured to the end of a cable 62, itself fixed to the end of an L-shaped stop piece 63 mounted so that it can pivot about an axle 64 and ending in a fluke 65 for fastening onto a stop 66 belonging to the preceding element 2. By virtue of these arrangements, it is easily understood that the tilting of the flap 60, by bringing about the pivoting of the stop piece 63, releases the fluke 65 from the stop 66, thereby rendering the two elements 2 of the grandstand free with respect to one another, such that the tensile force exerted on the drawbar 65 allows the first of these elements to be extracted then, by degrees, each of the next ones to be extracted.

Figure 13:
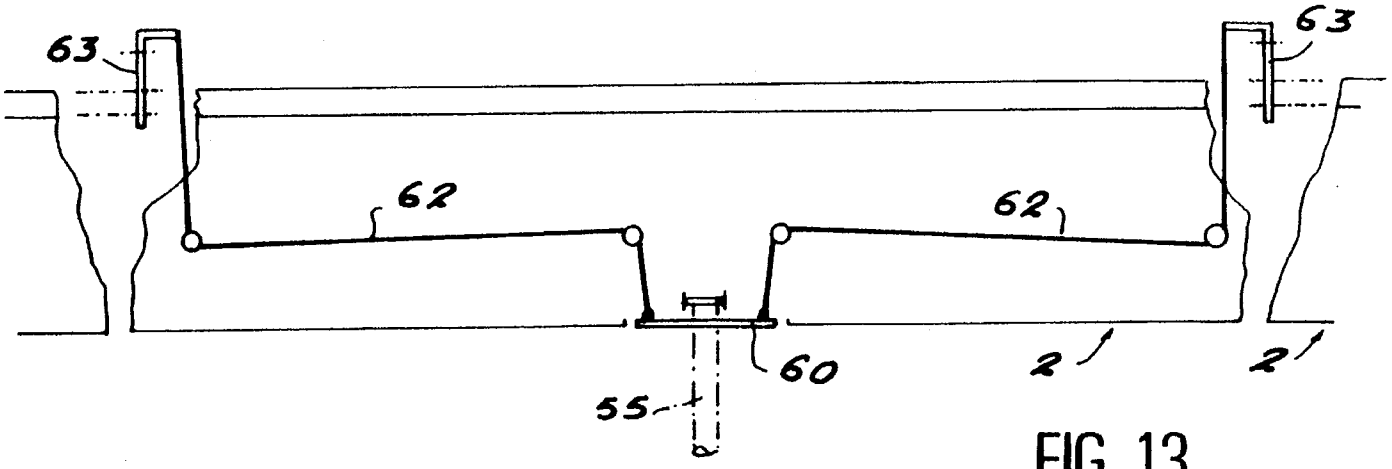
FIGS. 12 and 13 are views in elevation and in plan of the element which is right at the front of the grandstand, illustrating the means carried by this element in order to e train it, and, by degrees, to unfold or fold up the grandstand.
Figure 12:
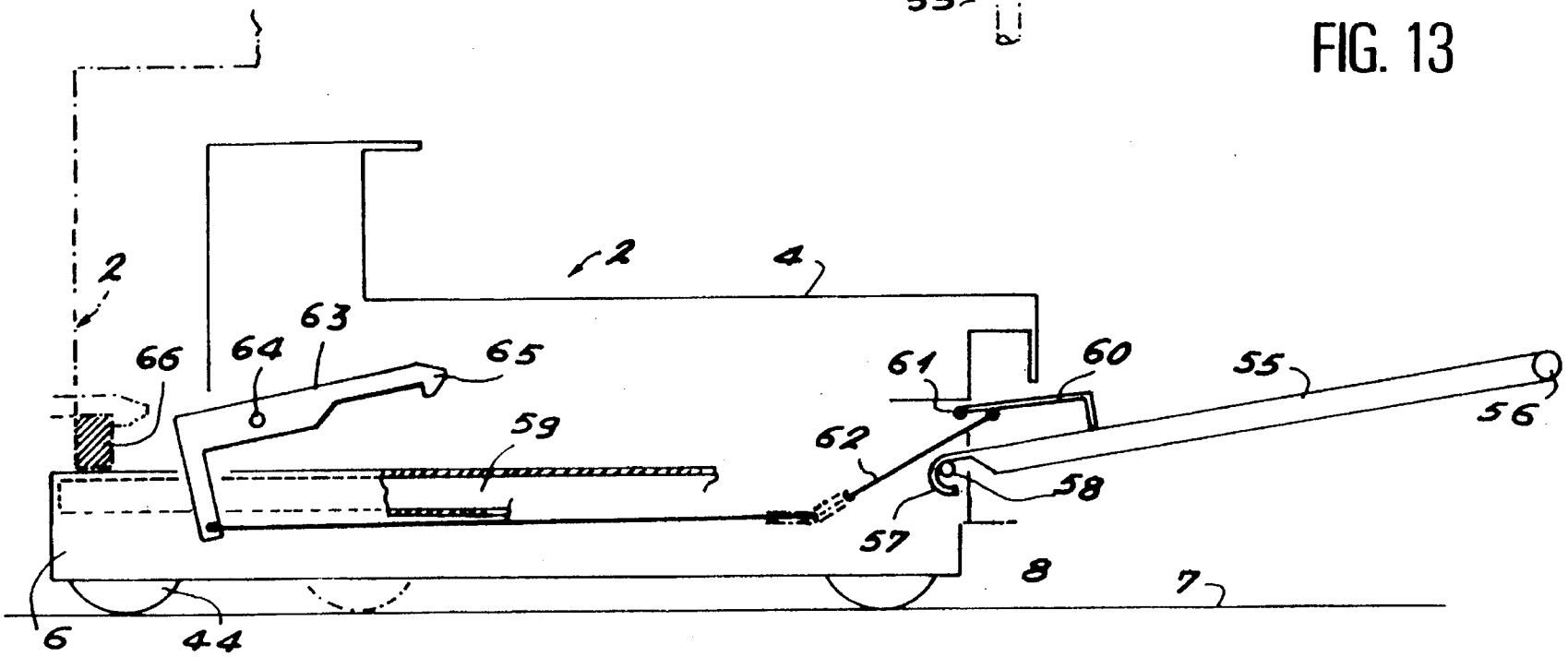

In this case, and as represented in FIG. 13, the cable 62 splits into two on each side of the flap 60 in order to actuate concomitantly two identical stop pieces 63 which simultaneously release the first element 2 from the next and so on for the whole of the grandstand.

In another variant, it is possible simply to envisage substituting for the assembly constituted by the pivoting stop piece 63, controlled by the cable 62, a simple bought-out lock which secures the lower element 2 carrying the drawbar 55 to the front part of the next element 2, so as to block the assembly in a strictly equivalent fashion.

Thus, a grandstand with telescopic steps is produced, of very simple design but which offers significant advantages by comparison with the embodiments already known in the state of the art, especially by allowing accurate and reliable guidance of the various elements of this grandstand, preventing any transverse offset of these elements during the movements bringing about the unfolding or folding up of this grandstand. The operation of the movement of the various elements may be produced manually or by electrically controlled means, the principle in all cases remaining the same, namely that the displacement of any element whatsoever is transmitted by degrees to the others until the grandstand has been completely deployed or, in contrast, entirely folded up on itself with all of its elements mutually nested.

Particularly, the combined implementation of pieces for mutual centering of the various bases each one supporting the platform of one element and of articulated compasses elements which permanently control the relative position of two successive telescopic elements depending on whether they are relatively open or closed, gives effective alignment of these elements at any moment, preventing Jamming or parasitic torsional loads which could otherwise be exerted on the structures of the grandstand.

Of course, it goes without saying that the invention is not limited to the exemplary embodiment more especially described hereinabove and represented with reference to the appended drawings; to the contrary, it encompasses all the variants thereof.

I claim:

1. A stepped grandstand, comprising a plurality of successive telescopic elements (2) each one supporting at least one row of seats (3), said elements having different successive heights, decreasing evenly from one element to the next from top to bottom of the grandstand (1), each element being capable of being housed under a previous one while surmounting the next one in a folded up position of the grandstand, (1) and in an unfolded position each element being completely extracted from the previous one and located in front of it, each row of seats being below with regard to the previous one located at a higher level and also above with regard to the one which is after it at a lower level, each element including a member for recentering (14, 15) in a plane in a direction of displacement of the element which unfolding the grandstand such that, by degrees, the directions of displacement of all the successive elements are strictly mutually parallel, each element has a shape of a portal frame with a horizontal upper platform (4) supporting the row of seats (3), and two lateral uprights (5) symmetric with respect to a median plane of the grandstand, extending along sides of this element, a next element being housed in a preceding element with its platform and lateral sides respectively parallel to those of said preceding element and under said preceding element, and in which each of the lateral uprights (5) of an element includes at least one leg (12) and on which the horizontal platform (4) of the element is fixed at an upper part of said leg and which leg is secured, at its lower part, to a support base (6) equipped with wheels (8) for displacement mounted so that they can rotate freely about a horizontal axles (45) carried by said base (6) and extending perpendicularly to the direction of displacement of the element, wherein the leg (12) of at least one of the uprights (5) of each element includes an open attached piece (14) in the shape of a V, having an apex (20) which is welded or otherwise secured to the leg along one generatrix thereof, and preferably in a median plane of the upright, said piece (14) interacting with a profiled centering finger (15) located in a median plane but carried by a support base (6) of the next element opposite the V-shaped piece attached to the leg of the latter, such that, after displacement of the base of a first element, a centering finger (15) carried by the base of the next element engages in the V-shaped piece of said first element, thereby aligning the two elements and so on from one element to the next.

2. The grandstand as claimed in claim 1, wherein the centering finger (15) is supported by a block (17) fixed to the support base 6) of one element (2) and extends, laterally overhanging above the support base (6) of an adjacent preceding element (2), this finger (15) including a rod which is bent (18) toward the V-shaped piece of said preceding element and terminating in a spherical head (19) facilitating its engagement in said V-shaped piece and gliding over at least one of its sides as far as the apex (20) in a median plane of the upright (5) which supports it.

3. The grandstand as claimed in any one of claims 1 or 2, wherein one of the legs (12) of at least one of the uprights (5) of each element (2) includes a locking level (21) which is articulated above a horizontal axle (23) carried by the leg (12), this lever including an operating arm (22) and a fastening fluke (24) designed to immobilize a preceding element with regards to a next element (2) at the end of relative displacement of these two elements, when the centering finger is engaged to a bottom of the V-shaped piece (14), the lever tilting under its own weight during displacement of the elements in order to interact, at an end of travel, with a stop piece (25).

4. The grandstand as claimed in claim 3, wherein the fastening fluke (24) includes a bevel (26) for facilitating its gliding over the stop piece (25) and being raised, through pivoting about its horizontal axle (23), the elements being set out such that they are successively locked from one element to the next in an unfolded position of the grandstand and unlocked in step with its successive elements being folded up.

5. The grandstand as claimed in any one of claims 1 to 2, wherein the elements (2) are joined to one another by means of a compasses member (30) comprising two branches (31, 32) which are articulated as a pair of scissors, ends of the two branches being respectively articulated onto one element and onto the adjacent element, while the other ends of these branches are articulated onto a guide (40, 41) mounted so that it can slide on a position-adjustment bar (42, 43), respectively carried by each of the two elements, such that opening or closing of the compasses element moves these elements apart or brings them together while a guide for each branch slides on an associated bar.

6. The grandstand as claimed in claim 5, wherein ends of each of the two branches (31, 32) of the compasses element (30) are respectively articulated to a tab (27) forming a vertically turned-down piece, provided in a front face of the first element and on an end wall (29) turned vertically upward formed on a rear face of the next element which carries the adjustment bar (42, 43), such that the compasses element which extends under the platform of the first element is open in a folded up position of the two elements, and closed in an unfolded position of these two elements.

7. The grandstand as claimed in any one of claims 1 to 2, wherein each support base (6) of the lateral upright (5) of an element (2) includes a self-contained drive member, with a roller (47) equipped with an incorporated axial motor (48), a rotation spindle (50) carried by the roller extending parallel to axles (45) of the wheels (8) for displacement of the element and being secured to a vertical groove (51) formed in the base (5), allowing the roller to bear on the ground (7) and allowing it a limited lift in unevenness of this ground.

8. The grandstand as claimed in claim 7, wherein the support base (6) includes, on either side of the roller (47), masses for ballast (52, 53), and for bearing on the ground.

9. The grandstand as claimed in claim 8, wherein the ballast masses (52, 53) consist of containers (54) filled with sand (53) or some other equivalent heavy material.

10. The grandstand as claimed in claim 1, wherein the element (2) of least height, designed to be located at the front of the grandstand in a deployed position, includes a manual drive member of a sliding drawbar type (55), ending in a hook (57) capable of interacting with a spindle carried by the base (6) of this element in order to allow a tensile force to be exerted on the element, ensuring its deployment.

11. The grandstand as claimed in claim 10, wherein the drive member drawbar (55) is mounted so that it acts on a flap (60) articulated to the base (6) and to which an end of a cable (62) is fixed, the other end of this cable being secured to a locking lever (63) capable of releasing the first element (2) as regards preceding element 2, and so on from one element to the next.

12. The grandstand as claimed in claim 1, wherein the element (2) of least height includes an ordinary bolt, making it possible to immobilize this element as regards the prior element in order to prevent unfolding of the grandstand when not in use.

* * * * *